US011821146B2

(12) United States Patent
Hofstaetter

(10) Patent No.: US 11,821,146 B2
(45) Date of Patent: Nov. 21, 2023

(54) METHOD AND DEVICE FOR TAMPING SLEEPERS OF A TRACK

(71) Applicant: Plasser & Theurer Export von Bahnbaumaschinen GmbH, Vienna (AT)

(72) Inventor: Josef Hofstaetter, Puchenau (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 438 days.

(21) Appl. No.: 17/261,780

(22) PCT Filed: Aug. 12, 2019

(86) PCT No.: PCT/EP2019/071549
§ 371 (c)(1),
(2) Date: Jan. 20, 2021

(87) PCT Pub. No.: WO2020/052879
PCT Pub. Date: Mar. 19, 2020

(65) Prior Publication Data

US 2021/0292977 A1 Sep. 23, 2021

(30) Foreign Application Priority Data

Sep. 13, 2018 (AT) ..... A 286/2018

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/16; E01B 27/17; E01B 27/20; E01B 35/00; E01B 2203/10; E01B 2203/12; E01B 2203/122; E01B 2203/127
See application file for complete search history.

(56) References Cited

U.S. PATENT DOCUMENTS 4,449,459 A * 5/1984 Cicin-Sain ..... E01B 27/16 104/12
4,563,953 A * 1/1986 Theurer ..... E01B 27/16 104/10

(Continued)

FOREIGN PATENT DOCUMENTS

AT 379 625 B 2/1986
AT 411 277 B 11/2003

(Continued)

OTHER PUBLICATIONS

Chinese Office Action dated Jul. 4, 2022 in Chinese Application No. 201980060201.1 with English Translation.

(Continued)

*Primary Examiner* — S. Joseph Morano
*Assistant Examiner* — Cheng Lin
(74) *Attorney, Agent, or Firm* — Collard & Roe, P.C.

(57) ABSTRACT

The invention relates to a method for tamping sleepers of a track by means of a tamping assembly comprising at least two tamping units which have tamping tools lying opposite one another in each case and supported on a lowerable tool carrier, wherein the tamping tools—actuated with a vibration—are lowered into a ballast bed during a tamping operation and squeezed towards one another via squeezing drives. In this, for tamping an obliquely-lying sleeper, the tamping tools or tamping tool pairs in a raised position are moved via a control by means of the squeezing drives in the squeezing direction with different adjustment paths in such a manner that the free ends of the tamping tools or tamping tool pairs rotate approximately about a common vertical rotation axis in order to adapt themselves to the oblique position of the sleeper. With this method according to the invention, the necessity of a separate mechanical rotation device is eliminated.

14 Claims, 5 Drawing Sheets

(56) References Cited

U.S. PATENT DOCUMENTS

| | | | | | |
|---|---|---|---|---|---|
| 4,576,095 | A | | 3/1986 | Theurer | |
| 5,031,542 | A | | 7/1991 | Theurer | |
| 5,052,306 | A | * | 10/1991 | Theurer | E01B 27/17 104/7.2 |
| 5,343,810 | A | * | 9/1994 | Theurer | E01B 27/17 104/12 |
| 6,014,815 | A | * | 1/2000 | Jager | E01B 35/00 33/651.1 |
| 6,389,979 | B1 | * | 5/2002 | Theurer | E01B 27/16 104/10 |
| 6,662,728 | B2 | | 12/2003 | Theurer et al. | |
| 9,957,668 | B2 | * | 5/2018 | Lichtberger | E01B 27/16 |
| 10,125,456 | B2 | * | 11/2018 | Vargas | E01B 27/16 |
| 10,240,300 | B2 | * | 3/2019 | Lichtberger | E01B 27/17 |
| 2016/0010287 | A1 | | 1/2016 | Lichtberger | |

FOREIGN PATENT DOCUMENTS

| | | | | | |
|---|---|---|---|---|---|
| CA | 1 215 583 | A | | 12/1986 | |
| CA | 2103609 | C | | 2/1994 | |
| CN | 1046577 | A | | 10/1990 | |
| CN | 1083884 | A | | 3/1994 | |
| CN | 105022358 | A | | 11/2015 | |
| CN | 105189868 | A | | 12/2015 | |
| CN | 107148501 | A | | 9/2017 | |
| DE | 32 46 099 | A1 | | 1/1984 | |
| EP | 0 584 055 | A1 | | 2/1994 | |
| EP | 2 770 108 | A1 | | 8/2014 | |
| EP | 3 239 398 | A1 | | 11/2017 | |
| GB | 2 230 546 | A | | 10/1990 | |
| GB | 2230546 | A | | 10/1990 | |
| JP | S59-8803 | A | | 1/1984 | |
| JP | H03-69703 | A | | 3/1991 | |
| JP | H07-166502 | A | | 6/1995 | |
| JP | 2002-146702 | A | | 5/2002 | |
| SU | 1220571 | A3 | | 3/1986 | |
| WO | 2017/097390 | A1 | | 6/2017 | |
| WO | WO-2017097390 | A1 | * | 6/2017 | E01B 27/16 |

OTHER PUBLICATIONS

International Search Report of PCT/EP2019/071549, dated Nov. 20, 2019.

Austrian Search Report in GM 8039/2019 dated Jun. 26, 2019 with English translation.

Indian Search Report in Indian Application No. 202127003152 dated Aug. 12, 2022.

* cited by examiner

METHOD AND DEVICE FOR TAMPING SLEEPERS OF A TRACK

CROSS REFERENCE TO RELATED APPLICATIONS

This application is the National Stage of PCT/EP2019/071549 filed on Aug. 12, 2019, which claims priority under 35 U.S.C. § 119 of Austrian Application No. A 286/2018, filed on Sep. 13, 2018, the disclosure of which is incorporated by reference. The international application under PCT article 21(2) was not published in English.

FIELD OF TECHNOLOGY

The invention relates to a method for tamping sleepers of a track by means of a tamping assembly comprising at least two tamping units which have tamping tools lying opposite one another in each case and supported on a lowerable tool carrier, wherein the tamping tools—actuated with a vibration—are lowered into a track ballast bed during a tamping operation and squeezed towards one another via squeezing drives. The invention further relates to a device for implementing the method.

PRIOR ART

To restore or maintain a pre-defined track position, tracks having a ballast bed are regularly treated by means of a tamping machine. During this, the tamping machine travels on the track and lifts the track grid, formed of sleepers and rails, to a target level by means of a lifting-/lining unit. Fixing in the new track position takes place by tamping the sleepers by means of a tamping unit. During the tamping operation, tamping tools (tamping tines) actuated with vibration penetrate into the ballast bed between the sleepers and consolidate the ballast underneath the respective sleeper in that oppositely-lying tamping tools are squeezed towards one another, Particularly in the region of switches and crossings there is the requirement to adjust the position of the tamping unit, prior to being lowered, to the position and alignment of the sleepers and rails. So-called universal- or switch tamping machines are known, the tamping units of which are mounted to be adjustable in multiple ways in order to enable a flexible positioning of the same. EP 0 584 055 A1 discloses such a track maintenance machine. In this, a tool frame with a tamping unit is arranged in a rotatable and displaceable manner on a machine frame. For example, a rotation device enables a rotation of the tool frame relative to the machine frame about a vertical axis. In this way, the position of the tamping unit prior to the actual tamping procedure can be adapted to the respective rail- or sleeper position, in particular to sleepers obliquely lying. During this, the additional weight and the structural requirements of the rotation device are put up with in order to ensure an optimal tamping of the sleepers in the switch- and crossing area.

SUMMARY OF THE INVENTION

It is the object of the invention to provide a simplification over the prior art for a method of the type mentioned at the beginning. A further object concerns the optimization of a device for implementing the simplified method.

According to the invention, these objects are achieved by way of a method according to claim 1 and a device according to claim 10. Dependent claims indicate advantageous embodiments of the invention.

The method is characterized in that, for tamping an obliquely-lying sleeper, the tamping tools in a raised position are moved via a control by means of the squeezing drives in the squeezing direction with different adjustment paths in such a manner that the free ends of the tamping tools rotate approximately about a common vertical rotation axis in order to adapt themselves to the oblique position of the sleeper. With this method according to the invention, the necessity of a separate mechanical rotation device is eliminated. This results in a weight saving which has a positive effect on the allowable axle loads of the track maintenance machine provided for carrying out the method. Furthermore, the machine dimensions are reduced, and there are cost advantages in production, transport and operation of the track maintenance machine. A further advantage is the simple adaptability of existing tamping units for optimized use in the case of sleepers lying obliquely.

In a simple embodiment of the method, the different adjustment paths are matched to one another via tamping assembly geometry data stored in the control. No additional sensors are required at the tamping unit since the position adjustments of the tamping tools, carried out by means of the control, are the result of the known geometry data.

In addition, it is advantageous if the different adjustment paths are pre-set in dependence on a rotation angle about the corn mon vertical rotation axis, said rotation angle being settable in particular by means of a first control element. In this way, an operator is able to adapt the position of the tamping unit to an oblique position of the sleeper to be tamped. During this, the sleeper is either freely visible, or a live image of the sleeper is transmitted via a video system to a control stand. Also, an automatic recognition of the oblique position and a position adjustment of the tamping unit can thus be carried out.

A further development of the method provides that at least one tamping unit is displaced via a transverse displacement drive in a transverse direction of the track over a transverse displacement path, and that the transverse displacement path is recorded in particular via a distance sensor. With this extended method, the tamping unit can be adapted even more flexibly to the requirements in the region of a switch or a crossing. For example, prior to being lowered, the tamping un it is positioned beside a rail branching off the main track.

In this, it is advantageous if the different adjustment paths are specified in dependence on the transverse displacement path. During this, in particular the use of a displacement sensor enables a precise feedback of the current position to the control in order to appropriately indicate the initial positions of the tamping tools.

In a further advantageous embodiment of the invention, an opening width to be set of the respective oppositely-lying tamping tools is defined in particular by means of a second control element. This extension of the method enables a simple adaptation to different sleeper widths or sleeper crib widths. The adjustments are carried out by an operator or in an automatized way.

A further improvement provides that a position of the common vertical rotation axis is set in particular by means of a third control element. In this manner, a flexible adapting to local conditions takes place. For example, in the switch region, the common vertical rotation axis is positioned symmetrically between the outermost rails of the main track and of the branch track.

For automatization of individual method steps or of the entire positioning operation, it is advantageous if, prior to a tamping operation, a sleeper position is detected by means of a sensor device, and if adjustment specifications derived therefrom are provided to the control. The relief of the operating personnel thus achieved results in a higher process reliability. In addition, the automatization enables a better reproducibility of the work results.

In a further embodiment of the invention, in a calibration operation, the squeezing drives are activated with the tamping tools raised in order to move the associated tamping tools from end position to end position and to record the time duration required to do so in each case. With a hydraulic squeezing drive, the squeezing path is a function of an opening duration of a control valve. In this, there may be deviations as a result of temperature fluctuations or other reasons, the effects of which are compensated by the calibration operation.

A device, according to the invention, for implementing one of the above-described methods comprises at least two tamping un its having tamping tools, lying opposite one another in each case and supported on a lowerable tool carrier, which are connected in each case to a squeezing drive and are actuatable with a vibration. In this, hydraulic control valves are associated with the squeezing drives, wherein these are controlled via a common control, and wherein the control is configured for pre-setting the different adjustment paths. In this manner, an adaptation to obliquely-lying sleepers is possible with a simple structure without a rotation device. By means of the hydraulic control valves coupled to the control, the different adjustment paths are set precisely. A great advantage consists in the simplicity of the system which does not require a separate sensor technology at the tamping unit.

In an advantageous further development of the device, the squeezing path for the respective squeezing drive is a pre-set function of the opening duration of the associated control valve. The respective function is stored in the control, so that, for setting a desired end position of the respective tamping tool, the associated control valve is opened for an exactly specified time.

It is additionally advantageous if at least one tam ping unit is arranged to be transversely displaceable relative to a machine frame, and if a displacement sensor coupled to the control is associated with this tamping unit to record a transverse displacement path. The transversely displaceable tamping unit enables in a simple manner a tamping of a branching-off rail line. By means of the displacement sensor, a precise feedback of the position of the tamping unit to the control takes place.

A further advantageous embodiment of the device provides that operating elements are arranged for pre-setting a rotation angle about the common vertical rotation axis and/or for pre-setting an opening width, to be set, of the tamping tools lying opposite in each case and/or for pre-setting a position of the common vertical rotation axis. The operating elements enable an operator to quickly and precisely adapt the position of the tamping unit to the local conditions prior to a lowering operation.

It is additionally advantageous if the control comprises a memory device in which for each squeezing drive adjustment path values are stored, in particular in dependence on a rotation angle about the common vertical rotation axis. The values of the adjustment paths are then immediately available and do not have to be computed continuously, so that the control only needs to fulfil limited requirements regarding computing power and data processing. Thus, the invention can be realized with simple electronic components.

A further improvement provides that a sensor device is arranged for automatic recording of a sleeper position and that, for providing setting specifications, the sensor device is coupled to the control. In this way, individual method steps or the entire method for positioning the tamping unit can be carried out in an automatized manner.

BRIEF DESCRIPTION OF THE DRAWINGS

The invention will be described below by way of example with reference to the accompanying drawings, There is shown in a schematic manner in.

DESCRIPTION OF THE EMBODIMENTS

Figure 1:
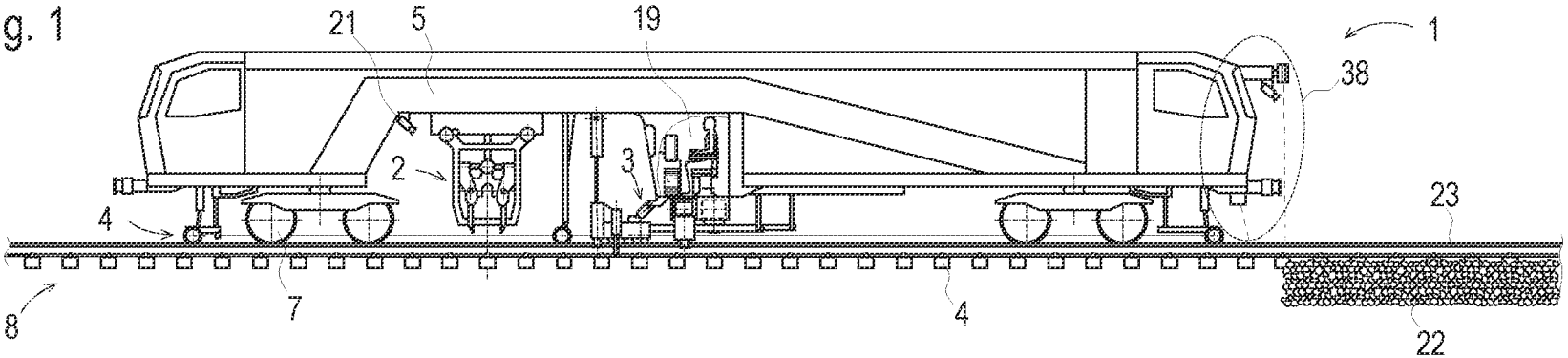
FIG. 1 a track maintenance machine with a tamping assembly

The track maintenance machine shown in FIG. 1 is configured as a tamping machine and comprises a tamping assembly 2, a lifting-/lining unit 3 and a measuring system 4. The tamping assembly 2 is fastened to a machine frame 5 and comprises several lowerable tamping units 6. The machine frame 5 is supported on undercarriages 7 and mobile on a track 8. In this, the invention has the advantage that a line tamping machine without rotatable suspension of the tamping assembly 2 can be used for tamping switches and crossings.

Figure 2:
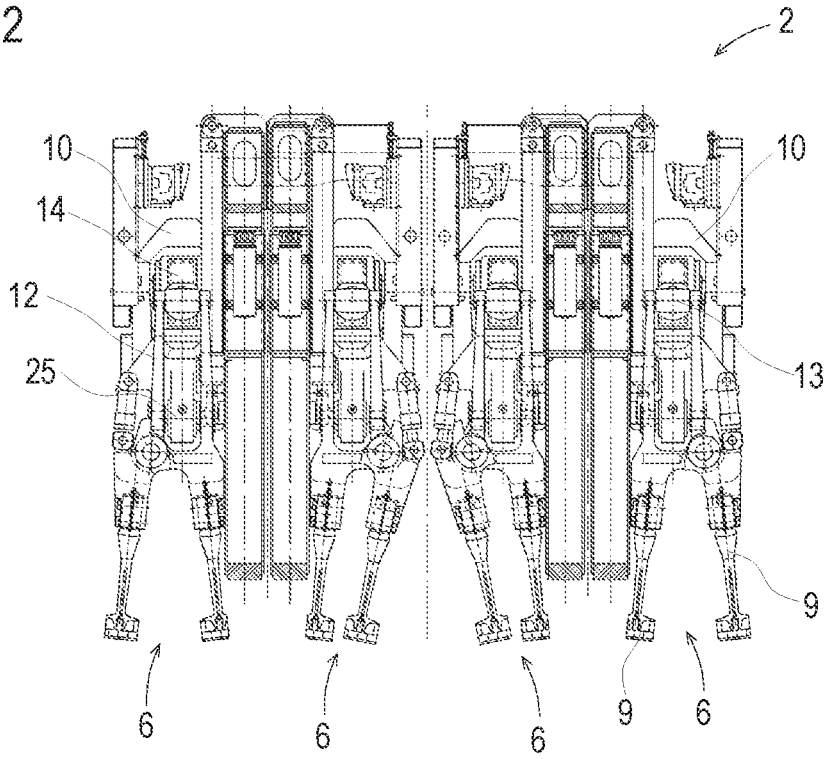
FIG. 2 a front view of a tamping assembly

FIG. 2 shows the tamping assembly 2 with four tamping units 6, each having four tamping tools 9. The four tamping tools 9 of the respective tamping unit 6 are supported in a lowerable manner on a tool carrier 10. In the present example, two tamping tool pairs per tamping unit 6 are arranged lying opposite one another and are squeezable towards one another, During a tamping operation, the two tamping tool pairs surround a sleeper 11 to be tamped. If the tamping region is too narrow (for example, in the region of a switch frog), one tamping tool 9 in each tamping tool pair can be pivoted up laterally.

Each tamping tool pair is coupled via a pivot arm 12 to a squeezing drive 13 and a vibration drive 14. The tamping units 6 are designed in such a way that total squeezing paths $b_0$ as large as possible can be realized. In addition, a large total opening width $w_0$ permits the problem-free tamping of double sleepers. With the present invention, the large total squeezing paths $b_0$ and large total opening width $w_0$ are used to adapt the position of the tamping tools 6 to an obliquely-lying sleeper 11. For tamping long sleepers in switches, it is advantageous if at least the outer tamping units 6 are designed to be displaceable in a transverse direction 15 of the track relative to the machine frame 5.

Associated with the tamping assembly 2 is a control 16 which is coupled to a first operating element 17 and a second operating element 18. The two operating elements 17, 18 are arranged at an operator panel on a control stand 19 of the track maintenance machine 1. Both operating elements 17, 18 are configured as rotary potentiometers, for example. Via the first operating element 17, an oblique sleeper position is pre-set by an operator. For example, a rotation angle α about a vertical rotation axis 20 is set. The oblique position of the sleeper 11 is detected by direct visual contact or by way of a video camera 21. By means of the second operating element 18, an opening width w of the respective to raping tools or tamping tool pairs lying opposite in each case is set. With this set opening width w, the tamping tools 9 penetrate into a ballast bed 22 of the track 8 when lowered.

Figure 3:
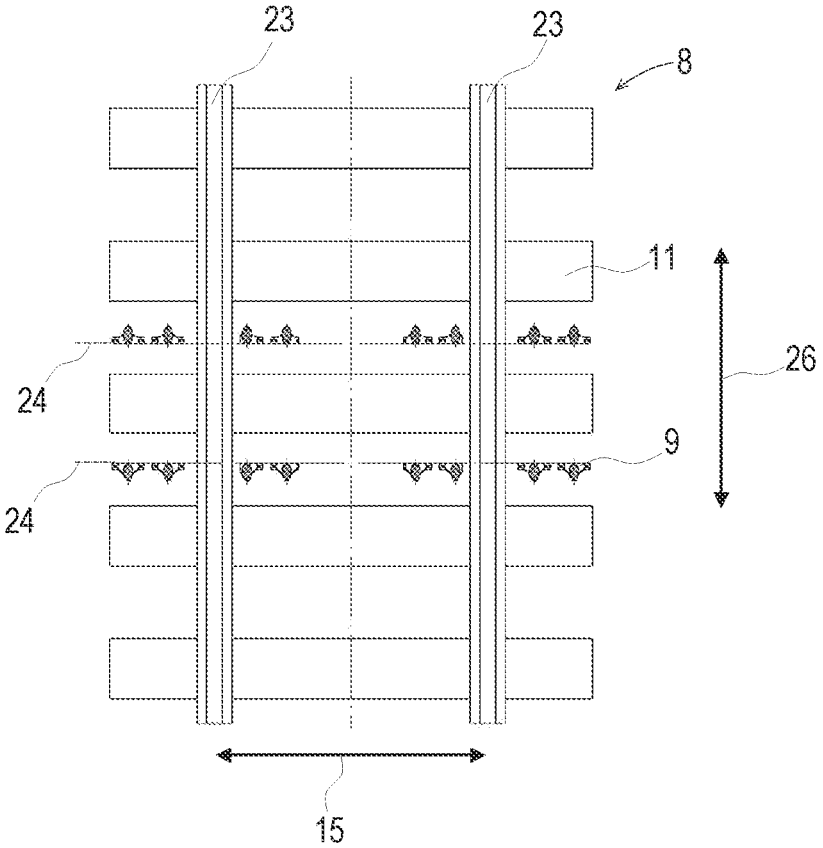
FIG. 3 a top view of a track section with tamping tools in position

FIG. 3 shows a positioning of the tamping assembly 2 without the method according to the invention. There is shown a top view of a straight track section with sleepers 11 aligned orthogonally to rails 23. The tamping assembly 2 is positioned above one of the sleepers 11, wherein the tamping tools 9 are shown in sectional view. The tamping tools 9 are situated at either side of each rail 23 in a starting position for carrying out a tamping operation. In doing so, tamping tools 9 situated above the same sleeper crib are aligned along a reference line 24 extending parallel to the sleeper 11.

Figure 4:
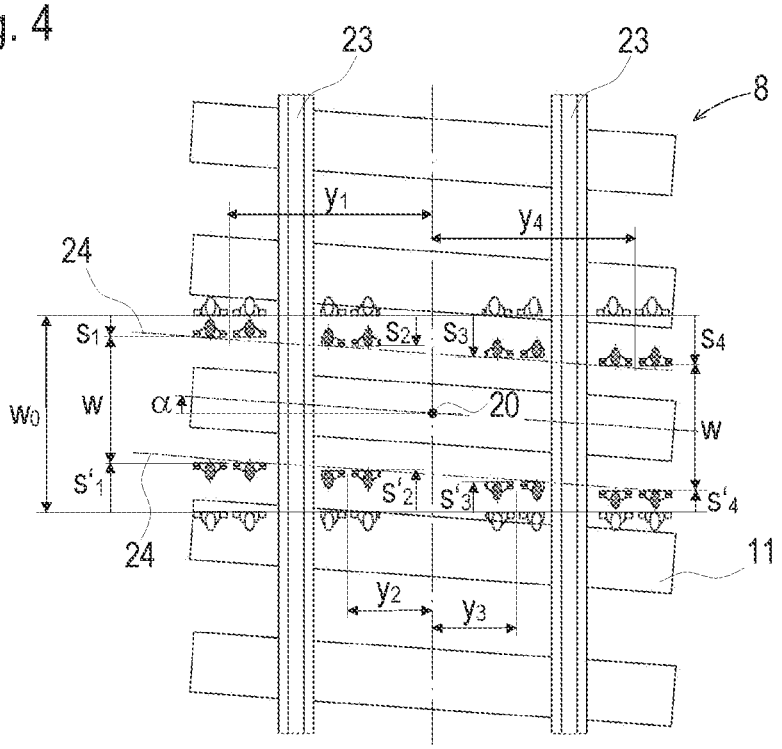
FIG. 4 a top view of a track section with obliquely-positioned sleepers and rotated positioned tamping tools FIG. 5 a top view of a track section with rotated positioned tamping tools FIG. 6 a top view of a track section with rotated positioned tamping tools and displaced common rotation axis FIG. 7 a front view of two tamping units FIG. 8 a side view of a tamping unit FIG. 9 a hydraulic diagram of a track assembly
Figure 5:
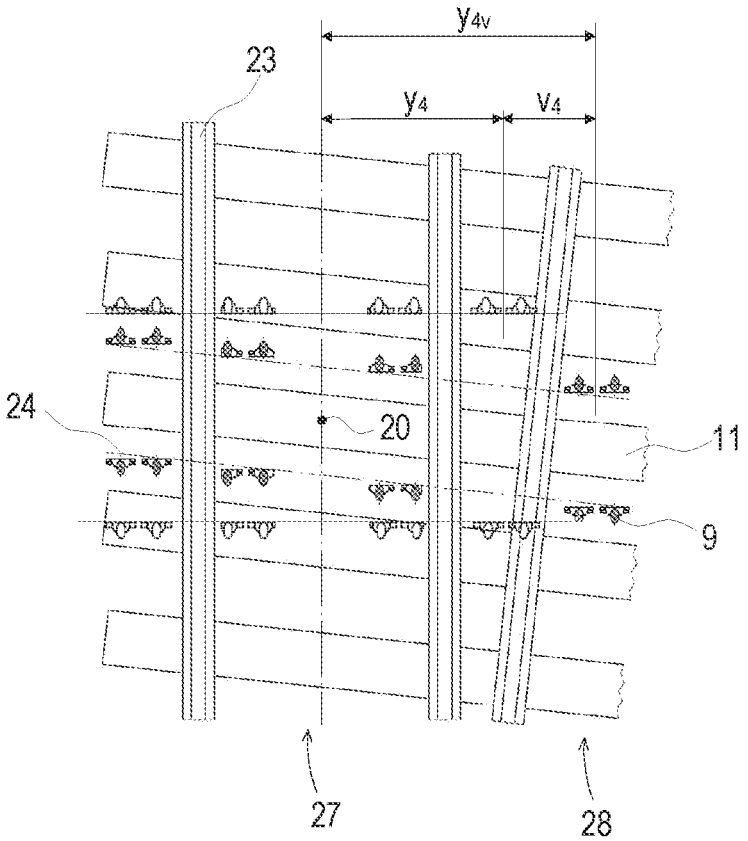
Figure 6:
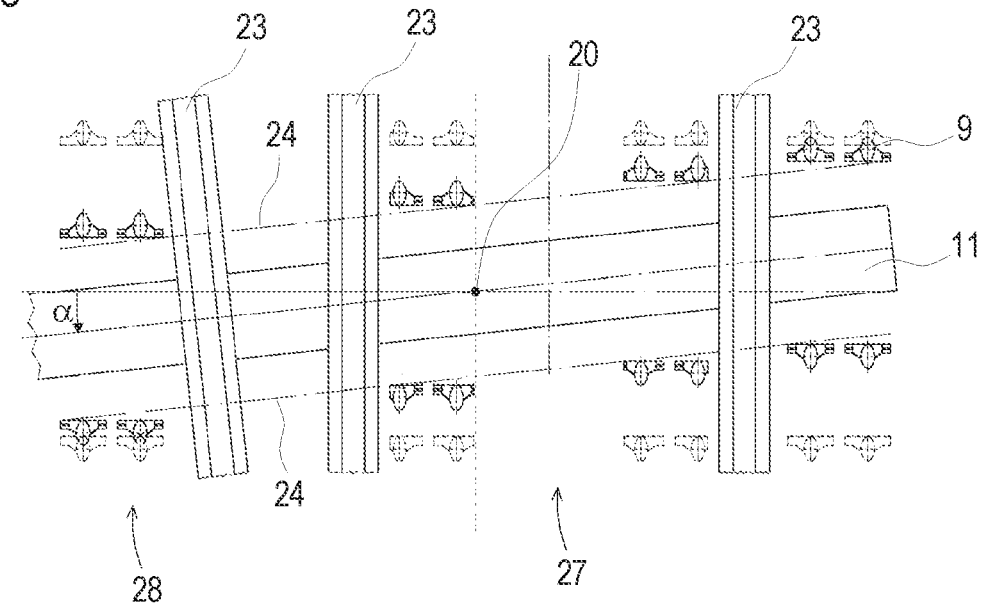

The invention is applied in the case of sleepers 11 lying obliquely, as shown in FIGS. 4 to 6. FIG. 4 shows a top view of a track section with two rails 23 and obliquely lying sleepers 11. Before the tamping units 6 are lowered into the ballast bed 22, the position of the tamping tools 9 is adjusted by means of the squeezing drives 13. In particular, the tamping tools 9 are pivoted in different ways about a horizontal pivot axis 25. In this, the tamping tools 9 lying closer to the vertical rotation axis 20 are pivoted less than the outer tamping tools. In this manner, the free ends of the tamping tools 9 (tamping tine plates) move in a squeezing direction 26 with different adjustment paths $s_1$, $s'_1$, $s_3$, $s'_3$, $s_4$, $s'_4$.

The positions of the tamping tool ends with the total opening width $w_0$ are shown in FIG. 4 in dotted lines. Starting from this, the adjustment paths $s_1$, $s'_1$, $s_2$, $s'_2$, $s_3$, $s'_3$, $s_4$, $s'_4$ are pre-set by means of the control 16 in such a way that the tamping tool ends are aligned above the respective sleeper crib along a common reference line 24 parallel to the sleeper 11. The result of this adjustment procedure, shown in solid lines, is equal to a rotation of the tamping tool ends with the rotation angle α about the common vertical rotation axis 20.

When specifying the rotation angle α, the individual adjustment paths $s_1$, $s'_1$, $s_2$, $S'_2$, $s_3$, $S'_3$, $s_4$, $s'_4$ result from the geometry of the tamping assembly 2. For example, the lateral distance $y_1$, $y_2$, $y_3$, $y_4$ of the respective tamping tool 9 or tamping tool pair with regard to the common vertical rotation axis 20 is stored in the control 16. The adjustment paths s, s' then ensue according to the following formulas:

$$s = \frac{w_0 - w}{2} - y \cdot \tan\alpha \text{ and } s' = \frac{w_0 - w}{2} + y \cdot \tan\alpha$$

In this, a chart with values for the respective adjustment path s, s' in dependence on the rotation angle α, the lateral distance y and the set opening width w can be stored in the control 16.

FIG. 5 shows a section of a switch with a rail line 28 branching off from the main track 27. Prior to the lowering of the tam ping units 6, the positions of the tamping tools 9 are set—as in the previous example—by means of the squeezing drives 13. As a result of the specifying of the adjustment paths $s_1$, $s'_1$, $s_2$, $s'_2$, $s_3$, $s'_3$, $s_4$, $s'_4$ matched to the tamping assembly geometry, this procedure resembles a rotation of the tamping tool ends about the common vertical rotation axis 20. In this, it should be noted that the right-hand outer tamping unit 6 is displaced additionally by a displacement path $v_4$ by means of a transverse displacement device. The displacement is carried out by operation of a corresponding displacement drive. During this, the displacement path $v_4$ is advantageously recorded by a displacement sensor 29 and reported back to the control 16. Via the described geometrical correlations, greater adjustment paths $s_4$, $s'_4$, are also pre-set in the case of enlarged lateral distance $y_{4v}$ in order to align the tamping tool ends along the respective common reference line 24. For the other tamping units 6, such a displacement may also be provided.

Shown in FIG. 6 is a switch section with a rail line 28 branching off the main track 27 to the left. For simplification of the geometrical relationships, the common vertical rotation axis 20 is displaced by means of a third operating element 30 to an axis of symmetry of the outer tamping units 1. This has the advantage that for each tamping tool end a minimized adjustment path $s_1$, $s'_1$, $s_2$, $s'_2$, $s_3$, $s'_3$, $s_4$, $s'_4$, is prescribed in order to attain the desired position.

Figure 7:
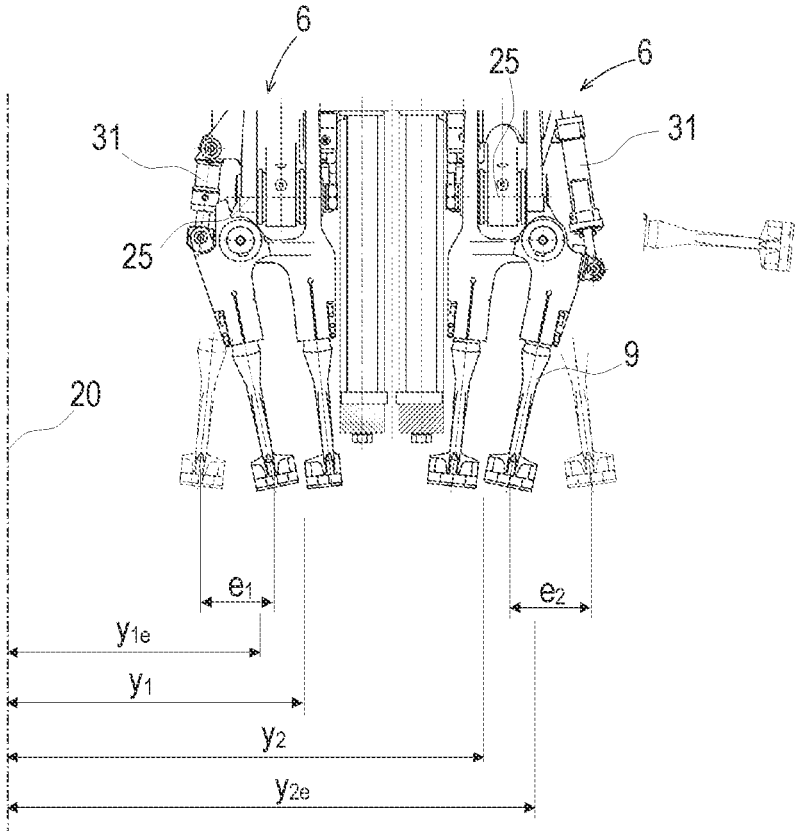

FIG. 7 shows two tamping units 6 which are positioned at both sides of a rail 23. The tamping tools 9 facing away from the rail 23 in each case are designed to be pivotable. These may be pivoted by means of the respective squeezing drive 31 all the way to a horizontal position if a tamping region is too narrow for two tamping tools 9 (for example, in the area of a switch frog). In another variant, the tamping tools 9 of a tamping unit 6 are merely spread apart in order to increase the widespread impact during tamping. In this, all the spreading paths $e_1$, $e_2$ of the tamping tools 9 are recorded and reported back to the control 11 in order to optionally adjust the prescribed adjustment paths $s_1$, $s'_1$, $s_2$, $s'_2$ of the tamping tool ends on the basis of a changed lateral distance $y_{1e}$, $y_{2e}$.

Advantageously, the control 11 has a memory device in which all end positions or geometry data of the tamping assembly 2 are stored. By means of these data, the required adjustment paths $s_1$, $s'_1$, $s_2$, $s'_2$, $s_3$, $s'_3$, $s_4$, $s'_4$ of the tamping tool ends are prescribed for a desired rotation angle α about the common rotation axis 20 and for each desired opening width w. In this, the displacements and/or pivoting of the tamping tools 5 in the transverse direction 7 of the track are also taken into account.

Figure 8:
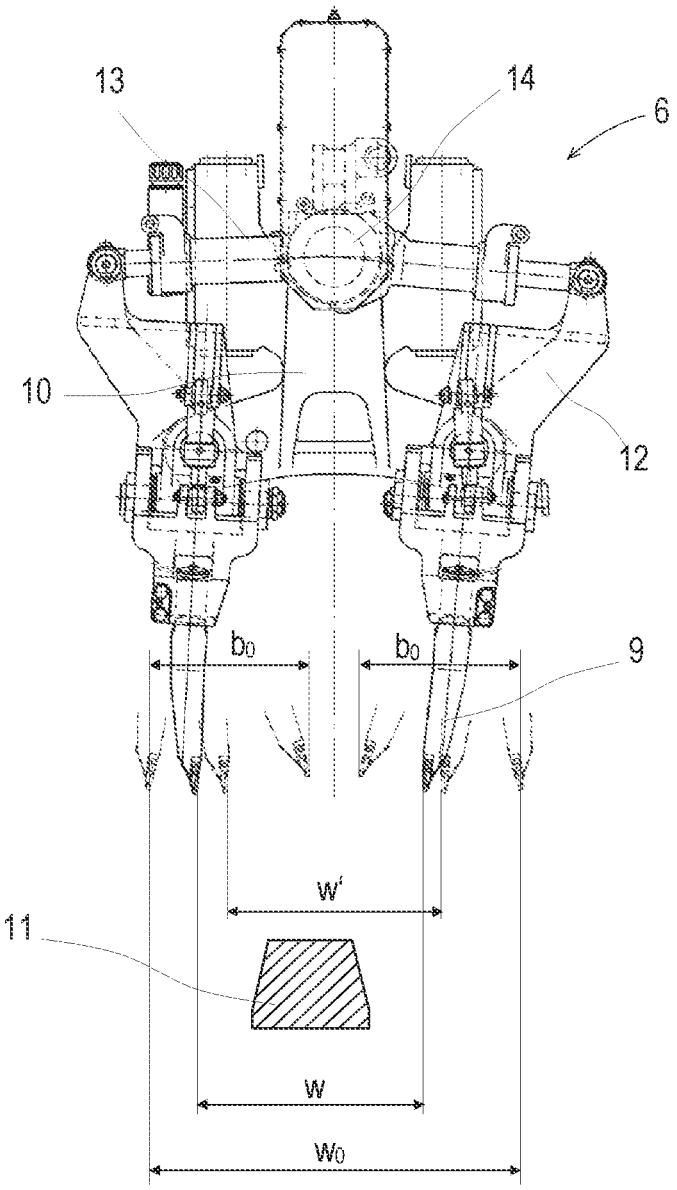

In FIG. 8, a tamping unit 6 is shown in a side view. Several squeezing positions and opening widths of the tamping tools 9 are drawn in dash-and-dot lines. The tamping tools 9 drawn in solid lines indicate the set opening width w for an obliquely lying sleeper 11. In addition, a total opening width $w_0$, a set opening width w' for a sleeper 6 not lying obliquely and the total squeezing path $b_0$ are shown.

Figure 9:
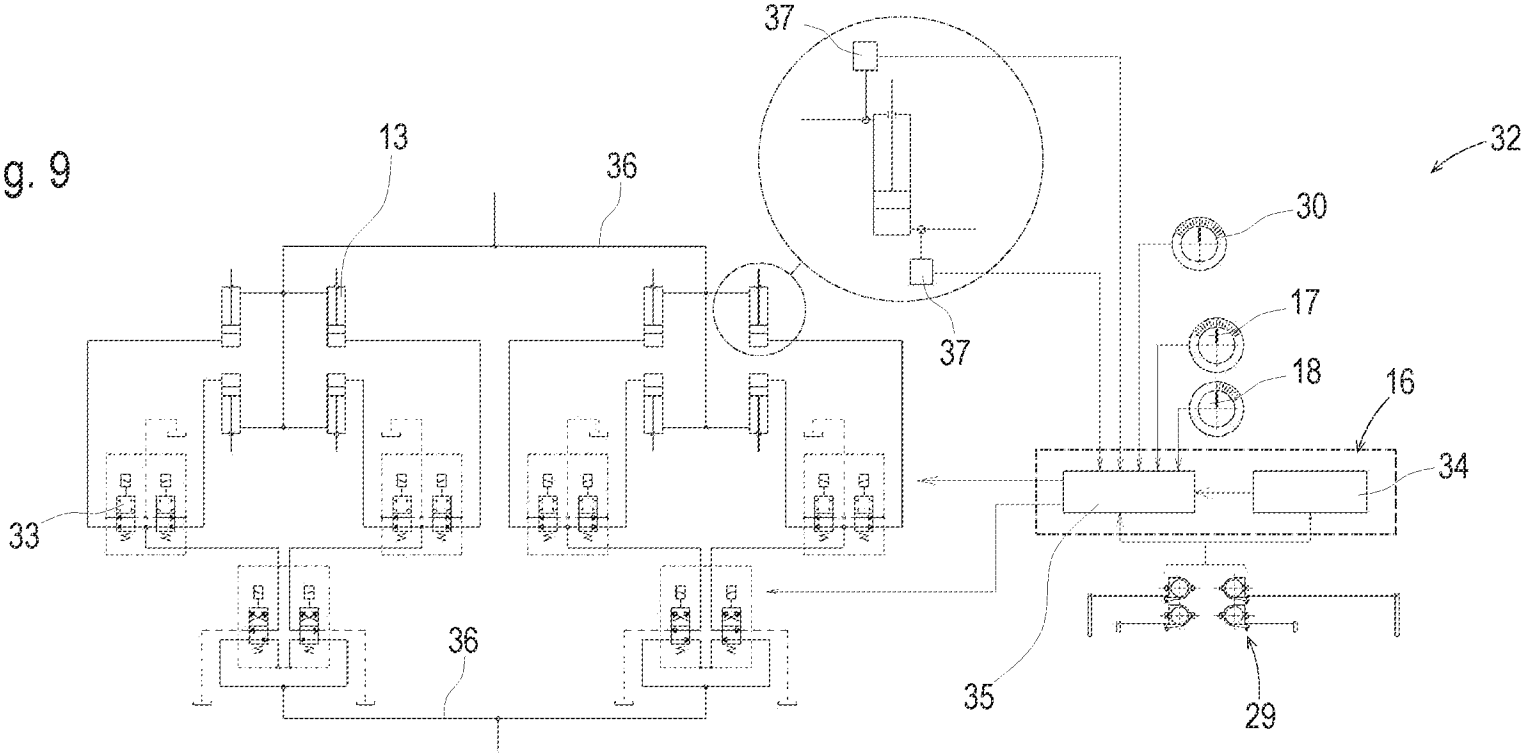

FIG. 9 shows a hydraulic schematic 32 of the described tamping assembly 2. Each of the four tamping units 6 has two squeezing drives 13 designed as hydraulic cylinders. Each squeezing drive 13 is separately controlled via control valves 33 (magnetic valves, for example). During this, a time-dependent valve control for achieving the required adjustment paths $s_1$, $s'_1$, $s_2$, $s'_2$, $s_3$, $s'_3$, $s_4$, $s'_4$ takes place. Advantageously, the control 11 comprises a general machine control 34 (which is already present in existing machines 1) and an auxiliary control 35 for the adjustment motions. Both control units 34, 35 are coupled to the displacement sensors 29 for recording a transverse adjustment path v or a spreading path e. Specification values for the rotation angle α, the opening width w to be set, and the position of the common vertical rotation axis 20 are transmitted to the auxiliary control 25 means of operating elements 17, 18, 30.

For calibration of the system, pressure transmitters 37 are arranged at hydraulic lines 36 of the respective squeezing drive 13. The pressure transmitters 37 detect the respective end positions of the hydraulic cylinders. During a calibration procedure, a complete squeezing takes place with the tamping assembly 2 raised, and the time is determined after which the end position of the respective hydraulic cylinder is reached. In this, various factors such as oil temperature, oil viscosity and ambient temperature play a role. The relations, thus established, between the actuation times and squeezing paths are used to calibrate the control for each squeezing drive 13 separately.

In the control 11 or the memory device, corresponding actuation times for the control valves 33 of the respective squeezing drives 13 can be stored instead of, or in addition to, the adjustment paths $s_1$, $s'_1$, $s_2$, $s'_2$, $s_3$, $s'_3$, $s_4$, $s'_4$. By corresponding actuation of the control valves 33, the adjustment procedure of the tamping tools 9 in the squeezing direction 26 takes place prior to the actual tamping procedure, so that the tamping tool ends align themselves along the parallel reference lines 24.

The control 11 is designed, for example, as a simple industrial computer which may be already present in the track maintenance machine 1. Existing machine controls 34 can be adapted with corresponding hard- or software. Also, virtual operating elements 17, 18, 30 on a monitor or touchpad can be used for adjusting the tamping assembly 2.

The present invention also relates to embodiments with automatic recording of a sleeper position. In this, the track maintenance machine 1 comprises a sensor device 38 which records a position or an oblique position of a sleeper 11. This sensor device 38 is arranged, for example, at the front side of the track maintenance machine 1 and comprises a laser scanner, an evaluation device and an odometer. Via the known distance between the sensor device 38 and the tamping assembly 2, the position of the sleeper 11 currently located under the tamping assembly 2 is always reported to the control 11. On the basis of the recorded data, an automatized adjustment of the positions of the individual tamping tools 9 or tamping tool pairs then takes place before the actual tamping procedure is carried out.

The invention claimed is:

1. A method for tamping sleepers of a track by means of a tamping assembly comprising at least two tamping units which have tamping tools lying opposite one another in each case and supported on a lowerable tool carrier, a squeezing drive and a control valve wherein the method comprises the following steps:

lowering the tamping tools—actuated with a vibration into a ballast bed during a tamping operation; and squeezing the tamping tools towards one another via squeezing drives, moving the tamping tools using a control for tamping an obliquely-lying sleeper, wherein the tamping tools or tamping tool pairs are moved in a raised position via said control by means of the squeezing drives in the squeezing direction with different adjustment paths in such a manner that the free ends of the tamping tools or tamping tool pairs rotate approximately about a common vertical rotation axis in order to adapt themselves to the oblique position of the sleeper;

setting a squeezing path for the respective squeezing drive as a pre-set function of the opening duration of the associated control valve.

2. The method according to claim 1, further comprising the step of matching the different adjustment paths to one another via tamping assembly geometry data stored in the control.

3. The method according to claim 1, further comprising the step of pre-setting the different adjustment paths in dependence on a rotation angle about the common vertical rotation axis, said rotation angle being settable in particular by means of a first control element.

4. The method according claim 1, further comprising the step of displacing at least one tamping unit via a transverse displacement drive in a transverse direction of the track over a transverse displacement path, and wherein the transverse displacement path is recorded in particular via a distance sensor.

5. The method according to claim 4, wherein the different adjustment paths are specified in dependence on the transverse displacement path.

6. The method according to claim 1, further comprising the step of setting an opening width of the respective oppositely-lying tamping tools or tamping tool pairs, wherein said width is defined in particular by means of a second control element.

7. The method according to claim 1, further comprising the step of setting a position of the common vertical rotation axis in particular by means of a third control element.

8. The method according to claim 1, further comprising the step of detecting a sleeper position prior to a tamping operation, by means of a sensor device, and wherein adjustment specifications derived therefrom are provided to the control.

9. The method according to claim 1, further comprising a step of performing a calibration operation, wherein the squeezing drives are activated with the tamping tools raised in order to move the associated tamping tools from end position to end position and to record the time duration required to do so in each case.

10. A device for implementing a method according to claim 1, comprising:

at least two tamping units having tamping tools or tamping tool pairs, lying opposite one another in each case and supported on a lowerable tool carrier, a squeezing drive coupled to each of said at least two tamping units and wherein said squeezing drives are actuatable with a vibration, wherein hydraulic control valves are associated with the squeezing drives and controlled via a common control, and wherein the control is configured for pre-setting the different adjustment paths;

wherein the squeezing path for the respective squeezing drive is a pre-set function of the opening duration of the associated control valve.

11. The device according to claim 10, wherein at least one tamping unit is arranged to be transversely displaceable relative to a machine frame, and wherein a displacement sensor coupled to the control is associated with this tamping unit to record a transverse displacement path.

12. The device according to claim 10, wherein operating elements are arranged for pre-setting a rotation angle about the common vertical rotation axis and/or for pre-setting an opening width, to be set, of the tamping tools lying opposite in each case and/or for pre-setting a position of the common vertical rotation axis.

13. The device according to claim 10, wherein the control comprises a memory device in which for each squeezing drive adjustment path values are stored, in particular in dependence on a rotation angle about the common vertical rotation axis.

14. The device according to claim 10, wherein a sensor device is arranged for automatic recording of a sleeper position and wherein, for providing setting specifications, the sensor device is coupled to the control.

* * * * *